US005502769A

United States Patent [19]

Gilbertson

[11] Patent Number: 5,502,769

[45] Date of Patent: Mar. 26, 1996

[54] INTERFACE MODULE FOR PROGRAMMABLE HEARING INSTRUMENT

[75] Inventor: Mark Gilbertson, Eden Prairie, Minn.

[73] Assignee: Starkey Laboratories, Inc., Eden Prairie, Minn.

[21] Appl. No.: 233,922

[22] Filed: Apr. 28, 1994

[51] Int. Cl.[6] ..... H04R 25/00

[52] U.S. Cl. ..... 381/68; 381/69; 381/69.2; 439/653

[58] Field of Search ..... 381/68.2, 60, 68, 381/68.4, 69.2, 69; 73/585; 128/746; 439/638, 650, 653

[56] References Cited

U.S. PATENT DOCUMENTS

| | | | |
|---|---|---|---|
| 4,701,958 | 10/1987 | Neth | 381/68 |
| 4,912,769 | 3/1990 | Erbe | 381/68.7 |
| 4,961,230 | 10/1990 | Rising | 381/69.2 |
| 4,989,251 | 1/1991 | Mangold | 381/68.2 |

FOREIGN PATENT DOCUMENTS

| | | | |
|---|---|---|---|
| 669296 | 2/1989 | Switzerland | 381/68.6 |

*Primary Examiner*—Forester W. Isen
*Assistant Examiner*—Xu Mei
*Attorney, Agent, or Firm*—Jay H. Maioli

[57] ABSTRACT

An interface module for a digitally programmable hearing instrument is detachably connected to the programming system by a cable and plug arrangement and has three large contact surfaces on an insertion module body that fits into a battery receptacle of the hearing instrument so that programming signals from the programming system can be fed to control the response of the hearing instrument. The interface module contains an electronic circuit unit that is detachable so that various interface circuits, such as a decoder, a processor, a level matching circuit, or an impedance matching circuit can be selectively included in the interface module. Each interface module can be color coded so that it can be associated with the proper left-ear or right-ear hearing instrument.

9 Claims, 4 Drawing Sheets

INTERFACE MODULE FOR PROGRAMMABLE HEARING INSTRUMENT

BACKGROUND OF THE INVENTION

1. Field of the Invention

This invention relates generally to a device for use with a programmable hearing instrument and, more particularly, to an interface module that can be easily connected between the hearing instrument and the programming system that adjusted the response of the hearing instrument.

2. Description of the Background

Auditory prosthesis, also known as hearing instruments or hearing aids, have been well-known for a long time. Recently, because of advances in semiconductor technology, such auditory prosthesis have become quite compact and have been able to include numerous features that were previously prohibited due to size and power constraints. For example, since around 1984 hearing instruments have incorporated means for modifying the response of the hearing aid. That is, it is possible for a hearing technician to tailor the response curve of the hearing instrument to the specific hearing impairment of the user for whom the instrument is being fitted. This is typically accomplished by storing the appropriate response coefficients in a memory circuit located inside the actual hearing instrument. The coefficient values are externally controllable by the hearing technician using a programming system and such a hearing instrument is generally referred to as a digitally programmable hearing aid.

While this kind of programmable hearing aid provides advantages to the user, there are also a number of problems associated with delivering the signal from the programming system to the hearing aid. Such problems are particularly present if the hearing aid is of the type known as an in-the-ear hearing aid. This type of hearing aid is quite small in size and has a reduced volume so as to fit, as the name implies, completely in the ear of the user. Other hearing aids known as behind-the-ear hearing aids have also been made much smaller in recent times due to the advances in semiconductor technology and manufacturing techniques.

In the case of the in-the-ear hearing aid, it is necessary to eliminate any signal input devices, in the form of input/output ports, that take up space on the hearing aid in order to achieve a cosmetically appealing instrument and one that is small enough to reside in the user's ear.

One approach to eliminating the necessary input/output ports or electrical connectors is to perform the digital programming by wireless transmission using ultrasonic signals or radio frequency transmissions. Both of these approaches, while eliminating the need for the input/output ports, require the use of additional circuitry inside the hearing aid in order to filter and demodulate the transmitted signals.

Another approach that has been proposed to accomplish connection of the programming signal to the hearing aid is to use a so-called battery pill. This approach involves removing the battery from the hearing aid and substituting a specialized connection device that approximates the exact configuration of the battery, but which has an electrical cable connected to it that is connected back to the programming system. The battery pill typically has three electrical contact areas on its outer surface, two of which provide the power to the hearing aid, such as might be normally provided by the battery, and the third contact is connected to another contact electrode inside the hearing aid. That third contact electrode is used for sending and receiving signals between the programming system and the hearing aid. One system of this kind is shown and described in U.S. Pat. No. 4,961,230.

All of the systems described above that have been known heretofore require either the use of additional circuitry to detect and decode the programming signals or have specialized mechanical requirements, such as having a battery door that permits the insertion of the battery pill, for example. In addition, none of the above systems permit interfacing with additional peripheral equipment without redesigning the hearing aid interconnection system.

OBJECTS AND SUMMARY OF THE INVENTION

Accordingly, it is an object of the present invention to provide an interface module for a programmable hearing aid that can eliminate the above-noted defects inherent in the prior art.

It is another object of the present invention to provide an interface module that can contain circuitry to permit any interface requirement to be easily provided.

A further object of this invention is to provide an interface module that is color coded relative to the left ear and the right ear so that the interface module can be associated with the proper hearing instrument.

A still further object of the present invention is to provide a modular configuration that permits additional electronic components and circuitry to be included in the interfacing system without requiring such circuitry to be incorporated in the hearing aid or incorporated as part of the programming system.

In accordance with an aspect of the present invention, an interface module is provided that is connected to a plug at one end of a cable that is in turn connected by a plug at its other end to the programming system and which easily fits into the battery receptacle of an in-the-ear hearing aid. Although the interface module is inserted into the battery receptacle of the hearing aid, the size or shape of the interface module is not dependent on the size or shape of the hearing aid battery door. By providing a detachable connector at the interface module, various peripherals can be added to enhance the programming signal, for example, for achieving a fine tuning of the fitting procedure or for performing electrical diagnosis of the hearing aid and the hearing aid programming circuit. Such additional circuitry can be made to reside within the interface module itself.

The above and other objects, features, and advantages of the present invention will become apparent from the following detailed description of illustrative embodiments thereof to be read in conjunction with the accompanying drawings in which like or similar elements are represented by the same reference numerals.

DETAILED DESCRIPTION OF PREFERRED EMBODIMENTS

Figure 1:
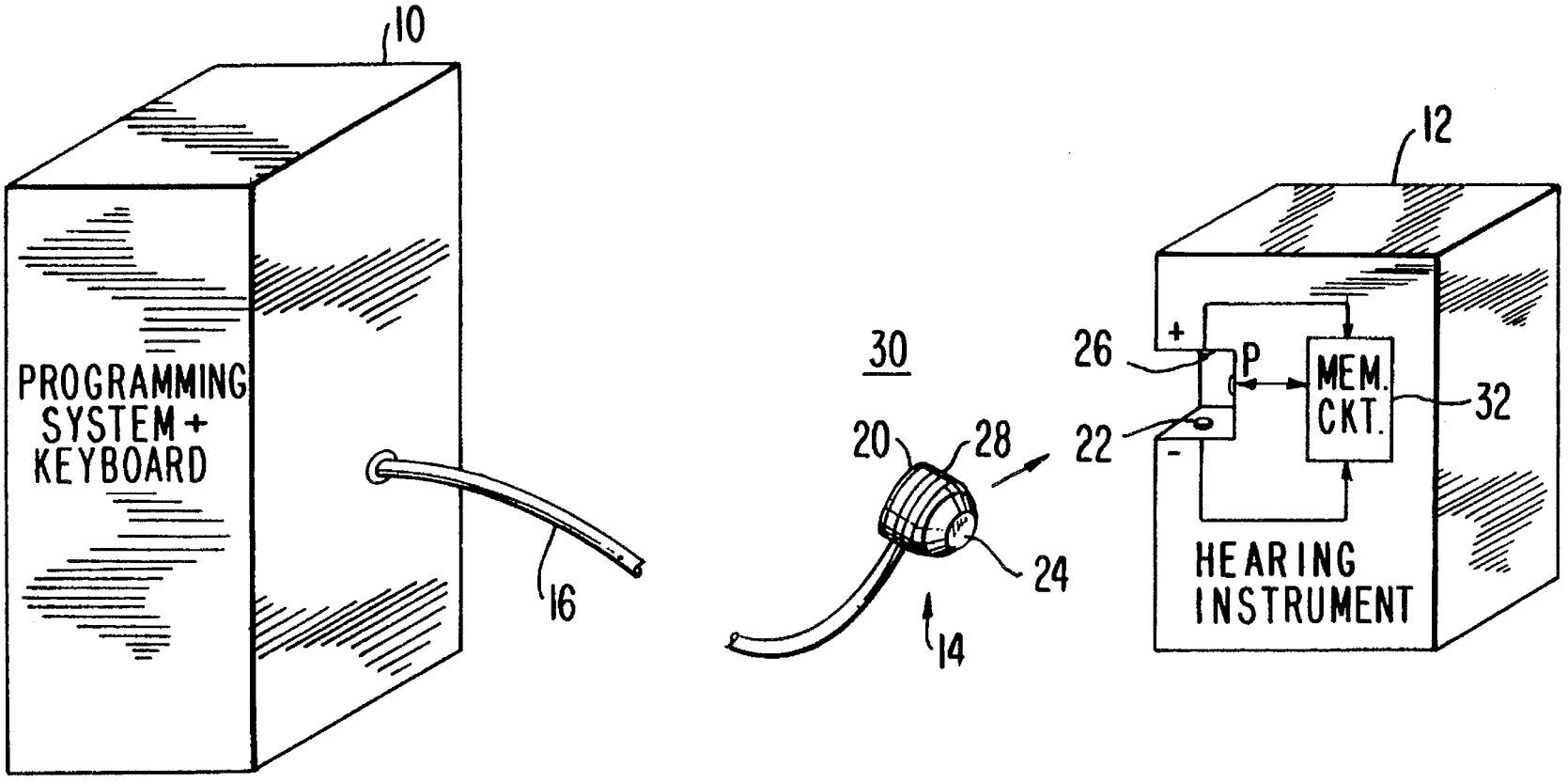
FIG. 1 PRIOR ART
FIG. 1 is a schematic illustration of a prior art system for connecting a programming system to a hearing instrument.

FIG. 1 schematically represents a conventional system for connecting a programming system and keyboard 10 that would be used by a hearing technician with a programmable hearing instrument, schematically represented at 12. This hearing instrument 12 can either be an in-the-ear hearing instrument or a behind-the-ear hearing instrument. Typically, in this prior art system, a so-called battery pill 14 is provided and is connected to the programming system 10 by a three-conductor cable 16. The battery pill is intended to fit in place of the regular battery inside the battery compartment 18 of the hearing instrument 12 and the hearing instrument is provided with three electrical contacts that contact the battery pill 14. More specifically, the battery pill 14 is provided with an electrical contact 20 to make connection to a negative power terminal 22 in the hearing instrument 12 and a positive contact 24 is provided to make connection to a positive power terminal 26 in the hearing instrument 12. A third contact 28 is connected to a third terminal 30 inside the hearing instrument 12 that represents the programmable input P, whereby the programming information from the programming system 10 is transmitted to the hearing instrument 12 to control its response. This is shown generally in FIG. 1 by the connection of terminal 30 to a memory circuit 32 that resides inside the hearing instrument 12. Memory circuit 32 is shown by way of example only and other circuit elements could also be connected to receive the programming signal.

Thus, it is seen by the use of this particular battery pill 14 that the battery door, not shown, in the hearing instrument 12 must be specially designed to permit access for the battery pill 14 and, further, that the battery pill itself must then have special size constraints to fit completely within the hearing instrument 12 so that the door can be closed.

Figure 2:
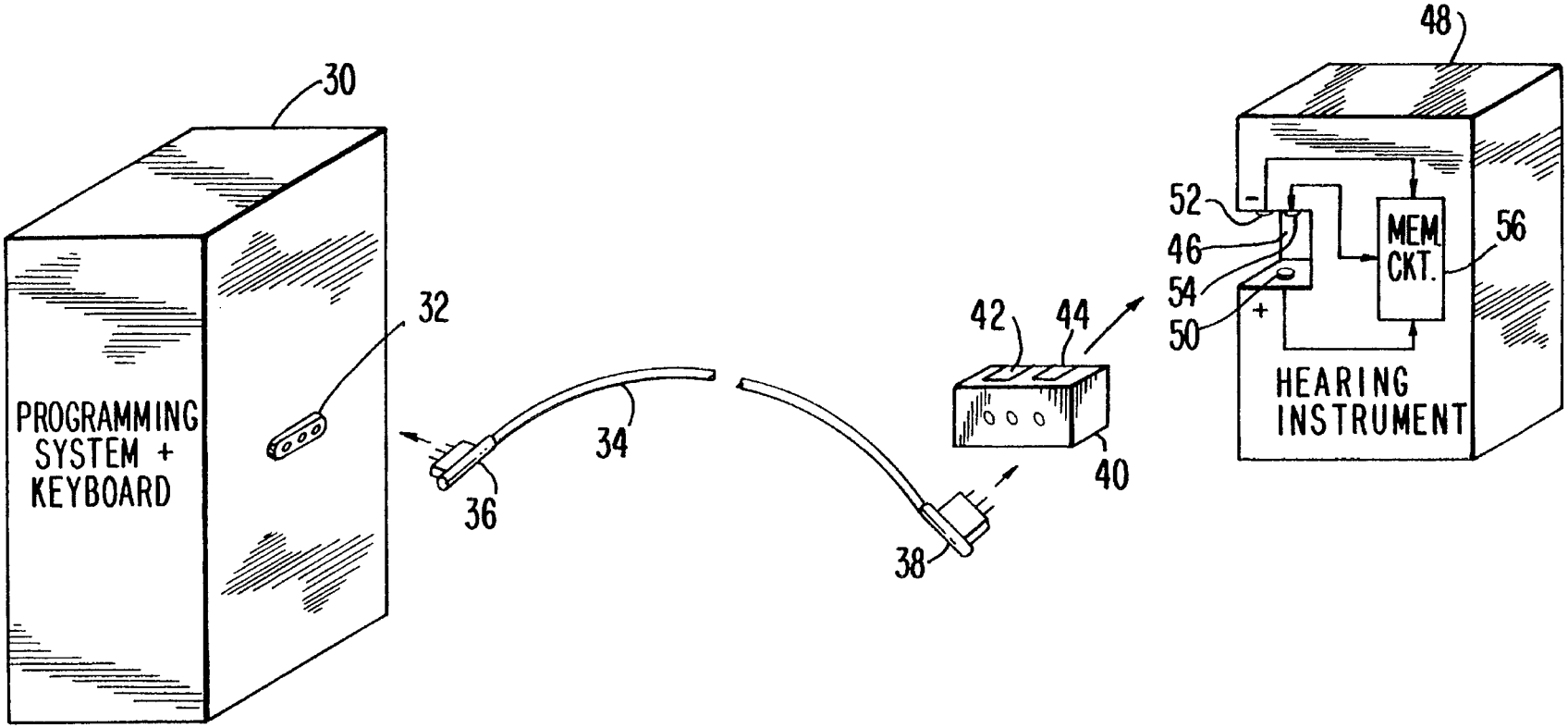
FIG. 2 is a schematic illustration of an embodiment of the present invention for use in connecting the hearing instrument to the programming system.

FIG. 2 schematically represents an embodiment of the present invention in which a programming system and keyboard 30 is provided with a three-pole jack 32 that cooperates with a plug on the interface cable 34. Specifically, one end of the interface cable 34 is provided with a three-prong plug 36 that fits into the jack 32. The other end of the interface cable 34 is provided with a second three-prong plug 38. This second three-prong plug 38 fits into the inventive interface module 40, which is schematically represented as a rectangular block. The interface module 40 itself has three external contact surfaces, two of which are shown at 42 and 44 in FIG. 2. The interface module fits into the battery receptacle or compartment 46 of the hearing instrument 48, which is schematically represented in FIG. 2.

The battery receptacle 46 of the hearing instrument 48 includes a positive contact 50 and a negative contact 52 that make electrical contact with the contact surfaces, such as 42, 44, on the interface module 40. Also included in the battery receptacle 46 of the hearing instrument 48 is a third contact 54 that provides the connection to feed the programming signals to the memory circuit 56 that is included in the hearing instrument circuitry. It is to be understood that the so-called memory circuit 56 is only used by way of example and the power and programming signals can be just as easily connected to any of the other circuits forming the hearing instrument 48.

Figure 3:
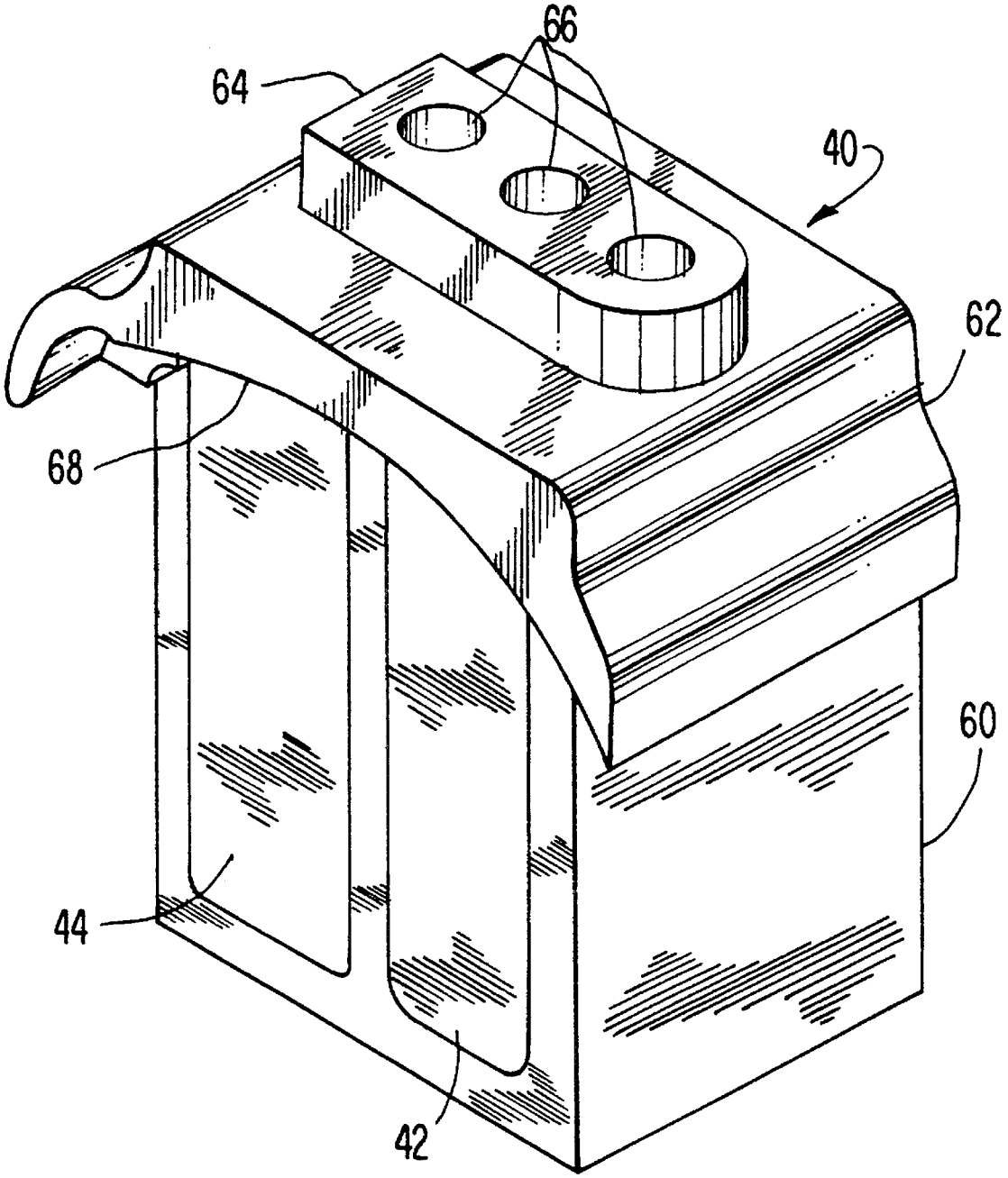
FIG. 3 is a perspective view of an interface module according to an embodiment of the present invention.

FIG. 3 is a perspective view of the interface module 40 shown in FIG. 2. The two electrical contact surfaces 42 and 44 are formed as flat plates embedded in one of the flat external surfaces of an insertion body 60. The other electrical contact surface can be on the opposite flat external surface of the insertion body 60 and is not shown in FIG. 3. As will be seen from FIG. 4, the insertion body 60 is initially hollow or empty and can contain an electronic circuit unit or printed circuit board containing various electronic components used to perform whatever impedance matching or decoding or level matching or the like may be required.

The interface module 40 also has an outer plate 62 bearing thereon an upraised land 64 that has formed therein three apertures 66 that receive the three pins or prongs of the connector 38. These pins are then electrically connected to the electronic circuit inside the insertion body 60 and are also electrically connected to the external electrical contacts, two of which are shown at 42 and 44. The outer plate 62 and land 64 are both advantageously formed of a plastic material and are color coded so as to distinguish between the left ear and right ear hearing instruments. Generally, the interface module 40 for the left ear is provided with a blue colored plastic outer plate 62 and the interface module 40 for the right ear is provided with a red colored plastic outer plate 62.

As indicated above, the interface module of this embodiment is intended to be advantageously used with an in-the-ear hearing aid and, as is known, the outer plate of such hearing aids are specially molded to provide a pleasing surface and to be generally unnoticeable when residing in the ear of the user. Thus, the outer element 62 has a lower surface, shown typically by the edge 68, that is intended to conform to this curved outer surface of the hearing instrument.

Figure 4:
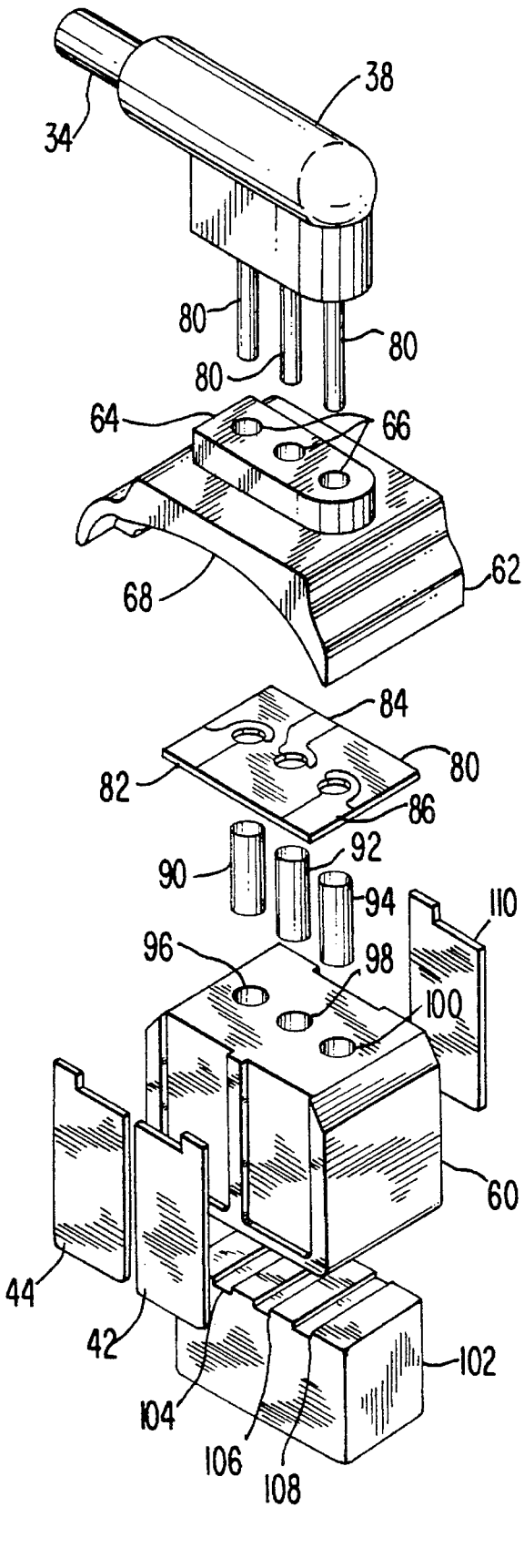
FIG. 4 is an exploded perspective view of a conductor and the interface module of FIG. 3 according to an embodiment of the present invention.

FIG. 4 shows the interface module 40 in an exploded view, so that all of the individual components thereof can be readily seen. More specifically, the outer plate 62 is shown separated from the insertion body 60 and it is seen that residing beneath the upper element 62 is a printed circuit board element 80 that has formed on one surface thereof three conductor patterns 82, 84, and 86. These conductor patterns are in electrical connection with three metal tubes 90, 92, 94, typically formed of brass, and the tubes 90, 92, 94 are respectively electrically connected with the contact areas 82, 84, 86 on the printed circuit plate 80. These tubes fit into respective apertures 96, 98, 100 formed in the insertion body 60 and extend through those apertures 96, 98, 100 to make electrical contact with an electronic circuit module 102. More specifically, at an upper surface of the electronic circuit module 102 are formed three conductors 104, 106, 108 that make respective electrical contact with tubes 90, 92, 94 that extend through the apertures 96, 98, 100, respectively.

The printed circuit board 80 has the conductor patterns 82, 86 formed thereon so as to be in electrical contact with the large contact plates 44 and 42, respectively, on one side of the insertion module 60. Similarly, conductor pattern 84 is in electrical contact with a third contact plate 110 on the opposite side of module 60. The contact plates 42, 44, and 110 can be placed in electrical contact with the conductor patterns 86, 82, and 84, respectively, by soldering or the like.

Thus, when the three prongs or pins 80 in the connector 38 of the interface cable 34 are inserted through the apertures 66 in the outer plate 62 they extend into and make electrical contact with the metal tubes 90, 92, and 94 that are also in electrical contact with the contact plates 42, 44, and 110 by means of the printed circuit board 80 and the pins 80 are also electrically connected with the electrical contact areas 104, 106 and 108 of the circuit module 102.

The electronic circuit module 102 can contain integrated circuits, thin film resistors, and the like and any kind of circuitry can be contained therein, for example, to decode programming signals, provide a wave shaping circuit, provide impedance matching, or to provide any signal conditioning that is necessary. The electronic circuit module 102 can be held inside the insertion module 60 by epoxy or the like or it can simply be press fit therein.

Although the present invention has been described hereinabove with reference to the preferred embodiment, it is to be understood that the invention is not limited to such illustrative embodiment alone, and various modifications may be contrived without departing from the spirit or essential characteristics thereof, which are to be determined solely from the appended claims.

What is claimed is:

1. An interface system for connecting a programmable hearing instrument having a programmable circuit and a battery receptacle with at least three electrical contacts therein to a source of programming signals, the system comprising:

an interface module having a rectangular, block-shaped insertion element for insertion into the battery receptacle of the hearing instrument, said insertion element having a plurality of flat contact plates formed on flat sides of said insertion element for respectively contacting the electrical contacts in the battery receptacle to which the programmable circuit is connected;

an electronic circuit module containing electronic components and having a plurality of external electrical contacts and being formed to reside within a hollow portion of said insertion element of said interface module and wherein said interface module includes means for making electrical contact between said plurality of external electrical contacts and said plurality of flat contact plates, respectively; and conductor means for electrically connecting the source of programming signals to said plurality of flat contact plates of said interface module to which said electronic circuit module is connected, whereby the programming signals from the source of programming signals are connected to said electronic circuit module and to the programmable circuit, wherein said means for making electrical contact comprises a plurality of metal tubes contacting respectively at first ends thereof said plurality of external electrical contacts and extending through a plurality of apertures formed in a flat surface of said insertion element and electrically connected at second ends thereof to said plurality of flat contact plates.

2. The interface system according to claim 1, wherein said interface module further comprises a printed circuit board having a conductor pattern for respectively electrically connecting said plurality of metal tubes at said second ends thereof and said plurality of flat electrical contact plates formed on said flat sides of said insertion element.

3. The interface system according to claim 2, wherein said conductor means comprises an electrical cable connected at one end to the source of programming signals and having a plug with a plurality of pins at the other end, and wherein said interface module includes an outer element with a second plurality of apertures formed therein for receiving said plurality of pins, said second plurality of apertures being aligned respectively with said second ends of said plurality of metal tubes, whereby upon insertion of said plurality of pins in said second plurality of apertures electrical contact is made between said plurality of pins and said plurality of tubes, respectively.

4. The interface system according to claim 3, wherein said outer element is formed of plastic material and is colored one of a red color or a blue color.

5. The interface system according to claim 4, wherein said electrical cable includes a second plug with a plurality of pins at said one end, and the source of programming signals includes a jack for connection to said second plug.

6. An interface connecting a hearing instrument having a programmable circuit and a battery compartment with three electrical contacts therein to a source of voltages and programming signals to be stored in the programmable circuit, the interface comprising:

an interface module having a rectangular, block-shaped insertion element for insertion into the battery receptacle of the hearing instrument, said insertion element having three flat electrical contact plates for respectively contacting the three electrical contacts in the battery compartment to which the programmable circuit is connected;

an electronic circuit module containing electronic components and having three electrical contact surfaces and being of a shape and size to reside within a hollow portion of said insertion element, and wherein said interface module includes means for electrically connecting said three flat electrical contact surfaces and said three electrical contact plates, respectively; and cable means for electrically connecting the source of voltages and programming signals to said three electrical contact plates of said interface module to which said electronic circuit module is electrically connected, whereby the voltages and programming signals are connected to said electronic circuit module and to the programmable circuit, wherein said means for electrically connecting comprises three metal tubes, first ends thereof contacting respectively said three contacts, said three metal tubes extending through three apertures formed in a flat surface of said insertion element and electrically connected at second ends to said three electrical contact plates.

7. The interface system according to claim 6, wherein said interface module further comprises a printed circuit element having a conductor pattern for respectively electrically connecting said three metal tubes at said second ends thereof and said three electrical contact plates.

8. The interface system according to claim 7, wherein said cable means comprises an electrical cable connected at one end by a first plug to the source of voltages and programming signals and having a second plug with a plurality of pins at the other end, said interface module including an outer element with a plurality of holes formed therein for respectively receiving said plurality of pins of said second plug, said plurality of holes being aligned respectively with said second ends of said three metal tubes, whereby upon insertion of said pins in said apertures electrical contact is respectively made between said pins and said tubes.

9. The interface system according to claim 8, wherein said outer element is formed of plastic material and is colored one of a red color or a blue color.

* * * * *